US008622587B2

(12) United States Patent
Preuschl et al.

(10) Patent No.: US 8,622,587 B2
(45) Date of Patent: Jan. 7, 2014

(54) LIGHTING DEVICE

(75) Inventors: Thomas Preuschl, Sinzing (DE); Florian Zeus, Barbing (DE)

(73) Assignee: Osram AG, Munich (DE)

( * ) Notice: Subject to any disclaimer, the term of this patent is extended or adjusted under 35 U.S.C. 154(b) by 151 days.

(21) Appl. No.: 13/148,670

(22) PCT Filed: Feb. 11, 2010

(86) PCT No.: PCT/EP2010/051703

§ 371 (c)(1), (2), (4) Date: Aug. 10, 2011

(87) PCT Pub. No.: WO2010/092110

PCT Pub. Date: Aug. 19, 2010

(65) Prior Publication Data

US 2011/0310624 A1 Dec. 22, 2011

(30) Foreign Application Priority Data

Feb. 12, 2009 (DE) ..... 10 2009 008 637

(51) Int. Cl.
*F21V 15/00* (2006.01)
*F21V 17/00* (2006.01)

(52) U.S. Cl.
USPC ..... 362/364; 362/362; 362/365; 362/373

(58) Field of Classification Search
USPC ..... 362/362, 364, 365, 368, 373, 249.01, 362/249.02
See application file for complete search history.

(56) References Cited

U.S. PATENT DOCUMENTS

| | | | | |
|---|---|---|---|---|
| 7,871,184 | B2 | 1/2011 | Peng | |
| 2003/0096450 | A1 | 5/2003 | Strauch | |
| 2006/0227558 | A1 | 10/2006 | Osawa et al. | |
| 2006/0232974 | A1 * | 10/2006 | Lee et al. | 362/294 |
| 2006/0250801 | A1 * | 11/2006 | Trenchard et al. | 362/294 |
| 2009/0175041 | A1 * | 7/2009 | Yuen et al. | 362/294 |

FOREIGN PATENT DOCUMENTS

| | | | |
|---|---|---|---|
| CN | 1880844 | A | 12/2006 |
| DE | 202007009655 | U1 | 10/2007 |
| DE | 202008006325 | U1 | 8/2008 |
| JP | 2006313717 | A | 11/2006 |
| JP | 2007295007 | A | 11/2007 |

OTHER PUBLICATIONS

English machine translation of DE 20 2007 009655 U1.
English Abstract of CN1880844 A. Dec. 20, 2006.
English abstract for JP 2006-313717 dated Nov. 16, 2006.
English abstract for JP 2007-295007 dated Nov. 8, 2007.

* cited by examiner

*Primary Examiner* — Anh Mai
*Assistant Examiner* — Kevin Quarterman

(57) ABSTRACT

A lighting device may include a heat sink, which has at least one carrier attached to the outside of the heat sink for at least one semiconductor light source; a recess for accommodating a driver; and at least one electrically insulating supply, which connects the recess to the outside of the heat sink; wherein the electrically insulating supply includes a contact surface that connects to the outside of the heat sink in a flush manner, the contact surface being at least partially covered by the carrier.

16 Claims, 5 Drawing Sheets

LIGHTING DEVICE

RELATED APPLICATIONS

The present application is a national stage entry according to 35 U.S.C. §371 of PCT application No.: PCT/EP2010/051703 filed on Feb. 11, 2010, which claims priority from German application No.: 10 2009 008 637.4 filed on Feb. 12, 2009.

TECHNICAL FIELD

Various embodiments relate to a lighting device, for example an LED retrofit lamp or an LED module for a retrofit lamp.

BACKGROUND

LED retrofit lamps or their light sources are typically operated with a safety extra-low voltage (SELV). For this purpose the LED retrofit lamp includes a driver for operating the LED(s) which includes a voltage regulator, typically a transformer, for converting a mains voltage, for example of 230 V, to a voltage of about 10 V to 25 V. The efficiency of an SELV driver is typically between 70% and 80%. With SELV devices insulation distances of at least 5 mm must be maintained between a primary side and a secondary side with respect to the voltage regulator to protect a user in order to be able to avoid an electric shock to the user caused by leakage currents. In particular, overvoltage pulses of up to 4 KV that originate from a voltage grid should be kept away from the secondary side, so there is no danger to the user even if he or she touches electrically conductive tangible parts, such as for example the heat sink, during the occurrence of the pulse.

LED retrofit lamps can, for example, be designed in such a way that the LED(s) are mounted on a carrier which is screwed to the heat sink and is electrically insulated therefrom. A required length of the leakage path or insulation between potential-carrying or electrically conductive surface regions (contact fields, conductive tracks, etc., for example on copper and/or conductive paste with, for example, silver) and the heat sink is achieved in that, firstly, the potential-carrying surface regions maintain a distance of at least 5 mm from an edge of the carrier and, secondly, an electrically insulating region of at least 5 mm is maintained around the screw connection points. Such a design has a large space requirement, however.

SUMMARY

Various embodiments provide a radiation-emitting apparatus for emitting a variable electromagnetic secondary radiation which may avoid the drawbacks described above.

The lighting device includes; a heat sink, which has at least one carrier attached to the outside of the heat sink for at least one semiconductor light source, a recess for accommodating a driver, and at least one electrically insulating supply, which connects the recess to the outside of the heat sink, wherein the supply includes a contact surface that connects to the outside of the heat sink in a flush manner, the contact surface being at least partially covered by the carrier. The carrier can, for example, be designed as a substrate, a printed circuit board or the like.

The heat sink can advantageously be made from a material having good heat conductivity with $\lambda>10$ W (m·K), particularly preferably $\lambda>100$ W (m·K), in particular from a metal such as aluminum, copper or an alloy thereof. The heat sink can, however, also be made completely or partially from a plastic material. A plastic material having good heat conductivity and which is electrically insulating is particularly advantageous for electrical insulation and lengthening of the leakage path. However, use of a plastic material having good heat conductivity and which is electrically conductive is also possible. The heat sink can preferably be symmetrical, in particular rotationally symmetrical, for example about a longitudinal axis. The heat sink can advantageously include cooling elements, for example cooling fins or cooling pins.

The type of semiconductor light source is basically unlimited but an LED is preferred as an emitter. The semiconductor light source may include one or more emitter(s). The semiconductor emitter(s) can be attached to a carrier on which additional electronic modules such as resistors, capacitors, logic chips, etc. can be mounted. The semiconductor emitters can, by way of example, be attached to the carrier by means of conventional soldering methods. The semiconductor emitters can, however, also be connected to a substrate ("submount") by chip level types of connection, such as bonding (wire bonding, flip-chip bonding), etc., for example by fitting a substrate made of AlN with LED chips. One or more submount(s) may also be mounted on a printed circuit board. Where a plurality of semiconductor emitters is present, these may emit in the same color, for example white, and this allows the brightness to be easily scaled. The semiconductor emitters can, however, also at least partially comprise a different emission color, for example red (R), green (G), blue (B), amber (A) and/or white (W). As a result an emission color of the light source can optionally be tuned and any desired color point can be adjusted. In particular it may be preferred if semiconductor emitters with different emission colors can generate a white mixed light. Instead of or in addition to inorganic light-emitting diodes, for example based on InGaN or AlInGaP, generally organic LEDs (OLEDs) may also be used. Diode lasers for example may also be used.

The carrier can be designed as a circuit board or a different type of substrate, for example as a compact ceramic body. The carrier may include one or more wiring layer(s).

The recess includes an insertion opening for insertion of a driver, for example a driver circuit board. The insertion opening of the recess can advantageously be located on a back of the heat sink. The insertion opening and the supply are advantageously located on opposing sides of the recess. The recess can for example be cylindrical in shape. The recess can advantageously be electrically insulated from the heat sink to avoid direct leakage paths, for example by means of an electrically insulating lining (also called housing of the driver cavity), for example in the form of a plastic tube pushed into the recess through the insertion opening. The lining may include one or more securing element(s) for securing the driver. The supply is used for supplying or putting through at least one electrical line between the driver located in the recess and the at least one semiconductor light source or the carrier fitted therewith. The supply and the lining can be designed in one piece as a single element. As the lining is inserted into the recess the supply is also simultaneously pushed through a feed-through opening in the heat sink.

The at least one electric line, which can be designed by way of example as a wire, cable or connector of any type, can be contacted by means of any suitable method, for example by means of soldering, resistance welding, laser welding, etc.

The driver can be a general control circuit for controlling the at least one semiconductor light source. The driver is preferably designed as a non-SELV driver, in particular as a transformer-less non-SELV driver. A non-SELV driver has a greater efficiency of typically more than 90% compared with a SELV driver and can, moreover, be built more cheaply. No safety distances are required in the driver from the primary side to the secondary side, as is stipulated in the case of an SELV driver when using a transformer. Instead a separation takes place between primary side and secondary side and principally between carrier and heat sink. With a transformerless non-SELV driver the transformer can advantageously be replaced by a coil or a buck configuration/a stepdown converter.

The part of the outside of the heat sink to which the carrier is secured, and the contact surface, connecting thereto in a flush manner, of the supply can advantageously form a common, plane face. In particular the carrier can rest partially on a plane front face or end face of the heat sink and partially on the contact surface connecting thereto in a flush and coplanar manner, or can cover this contact surface. The carrier does not need to rest in a planar manner over the entire surface it covers but can, by way of example, also be partially spaced apart from the surface it covers by way of a gap.

By providing the electrically insulating contact surface (i.e. the contact surface made of electrically insulating material) the leakage path can be laterally shortened and a laterally more compact lighting device achieved thereby. Therefore, by way of example for the case where an inner edge of an electrically insulating carrier rests on the contact surface, the leakage path may be extended by the lateral distance of the inner edge from the electrically conductive heat sink. Consequently potential-carrying faces of the carrier can be positioned closer to the edge by the same distance, whereby the carrier can in turn make do with less lateral (sideways) extension. Generally a leakage path in the region of the contact surface of the supply can be lengthened by the electrically insulating design thereof since the leakage currents then have to cover a long distance to the heat sink. Electrically conductive, in particular non-isolated, surfaces may advantageously include copper and/or conductive paste with, for example, silver.

The carrier can advantageously be secured to the heat sink by means of an electrically insulating interface layer. The electrically insulating interface layer can advantageously be adhesive on both sides for reliable joining between carrier and heat sink. The interface layer can advantageously be a thermal interface material (TIM) such as a heat conductive paste (for example silicone oil with additives of aluminum oxide, zinc oxide, boron nitride or silver powder), a film or an adhesive. The film can, for example, also be provided with an adhesive on both sides in the manner of a double-sided adhesive tape. The adhesive can, for example, be attached by means of a dispersing process and subsequent spreading with a doctor knife. The interface layer can, moreover, exhibit the advantages of a high dielectric strength and a lengthening of the leakage path. A screw-less construction can also be achieved by way of the interface layer, due to which an insulating region on the carrier which is otherwise required can be omitted around the screw feedthrough to the heat sink. This also facilitates a compact construction of the lighting device.

However, the carrier can basically also be secured to the heat sink in other ways. Therefore the carrier can also be screwed to the heat sink or through the heat sink to the lining of the driver cavity by means of one or more plastic screw(s). A further possibility for securing the carrier is to use a plastic pin integrated in the lining of the driver cavity and which projects through the heat sink and through the carrier. The pin can be hot swaged by way of example to secure the carrier. Securing by means of riveting, in particular wobble riveting, is also possible, specifically by using plastic rivets. Securing by means of a screw by way of example, in particular a plastic screw, guided centrally through the carrier is also possible. In this case the supply can inter alia be arranged eccentrically. A further possibility of securing consists in magnetic securing, for example integrated or secured in the lining by a magnetic pole and secured, for example by gluing, etc., to the carrier by a magnetic antipole.

Generally the supply can also be arranged eccentrically, for example laterally offset from the longitudinal axis of the hear sink or the substrate. The supply can also be arranged outside a lateral extension of the carrier. The at least one electric line can then be guided from laterally outside to the carrier.

The thermal interface material can advantageously extend laterally beyond the carrier over an inner edge and/or an outer edge. The leakage path can consequently be lengthened at the respective edge by the length by which the thermal interface material laterally projects beyond the respective edge.

The carrier may advantageously include at least one electrically insulating insulation layer. An insulation layer can particularly advantageously be made from a material or material composite having good heat conductivity and poor electrical conduction at least in the thickness direction. An insulation layer made of ceramic, such as $Al_2O_3$, AlN, BN or SiC is particularly advantageous. The insulation layer can be designed as a multi-layer ceramic carrier, for example using LTCC technology. Layers with different materials, for example with different ceramics, may also be used by way of example here. These may, by way of example, be designed so as to be alternately highly dielectric and poorly dielectric. The at least one insulation layer may also be made from a typical printed circuit board base material, such as FR4, which is less advantageous thermally but is very inexpensive. The insulation layer may be attached to one or both side(s). In particular the use of an insulated metal substrate (IMS) or a metal core printed circuit board (MCPCB) is also conceivable as a carrier.

The carrier can advantageously comprise a dielectric strength of at least 4 KV so overvoltage pulses of at least this size do not penetrate the carrier.

The carrier may advantageously include at least one insulation layer and a metal layer arranged on the underside thereof, wherein the underside metal layer is laterally set back at an inner edge of the carrier. A leakage path at an edge of the carrier can consequently be lengthened even further since a leakage current then has to cover an additional distance from the edge of the base material layer to the metal layer and further from the base material layer to the edge of the thermal interface material. It may be particularly advantageous if the underside metal layer is set back from the inner or inside edge of the carrier by more than 1 mm. Together with the thermal interface material a leakage path or insulation section which is particularly compact in the lateral plane is thus produced which is S-shaped in depth. For simple attachment and shaping the underside metal layer can advantageously be a DCB ('Direct Copper Bonding') layer made of copper. The carrier can also have a DCB layer at the top, however.

Alternatively or additionally it may analogously be advantageous if the carrier comprises at least one insulation layer and a metal layer arranged on the underside thereof, the underside metal layer being laterally set back at an outer edge of the carrier.

To achieve a particularly advantageous compromise between maximization of the insulation section on the one hand and a minimization of the thermal path between light source(s) and heat sink on the other hand, a thickness of the carrier can advantageously be in a range between 0.16 mm and 1 mm.

Generally it may be preferred if a leakage path is at least 1 mm long, particularly preferably at least 5 mm.

An at least local heat conductivity or heat spread of the carrier can advantageously be between 20 (W/m·K) and 400 (W/m·K), for example about 400 (W/m·K) for a copper layer.

It may be advantageous if the supply includes a projection protruding outwardly at the outside of the heat sink, wherein a surface of the projection and the contact surface form a step, in particular a rectangular step. The projection can advantageously protrude perpendicularly from a plane face of the heat sink, for example a plane end face. Substantially uniform component geometry in the circumferential direction can be achieved in particular as a result. The carrier can also therefore be placed with slight clearance (at a slight distance) around the outwardly-pointing projection of the supply, and this also facilitates a compact construction. The projection can be used as a centering aid during assembly of the carrier on the heat sink. The carrier may include a central opening for this purpose.

For uniform distribution of a plurality of LEDs with a simultaneously simple design of the leakage path while maintaining predefined insulation sections, it may be advantageous if the carrier is arranged circumferentially and concentrically or coaxially with respect to the supply. A slight lateral extension of the carrier relative to a longitudinal axis of the heat sink is also achieved in this way. To maintain predefined insulation sections it may be advantageous if the LEDs are uniformly arranged in the circumferential direction.

To ensure reliable securing of the carrier on the heat sink it may be advantageous if the lighting device also comprises at least one pressure element for pressing the carrier onto the heat sink.

For uniform application of pressure and the avoidance of bending stresses in the carrier that result therefrom and avoidance of local lifting thereof, the pressure element can advantageously comprise a circumferential or part-circumferential, in particular sectored, ring made of a(n)—in particular electrically insulating—material.

For simple assembly the lighting device can advantageously comprise a((n) at least partially light-permeable) bulb (clamped for example to the heat sink) which includes a contact aid which presses onto the carrier and/or the pressure element to allow an additional contact pressure onto the heat sink. The bulb can, by way of example, be equipped with a contact aid in the form of a circumferential holding-down device for the carrier.

To maintain a required leakage path, at the top the carrier may advantageously include at least on electrically conductive surface region which maintains a minimum distance from an inner edge of the carrier and/or an outer edge of the carrier, in particular a minimum distance of 3.5 mm or more.

The semiconductor light source can advantageously be fed by means of a non-SELV voltage although use with a safety extra-low voltage (SELV) is also possible.

The lighting device can particularly advantageously be designed as a retrofit lamp, in particular an LED retrofit lamp, or as a module therefore.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
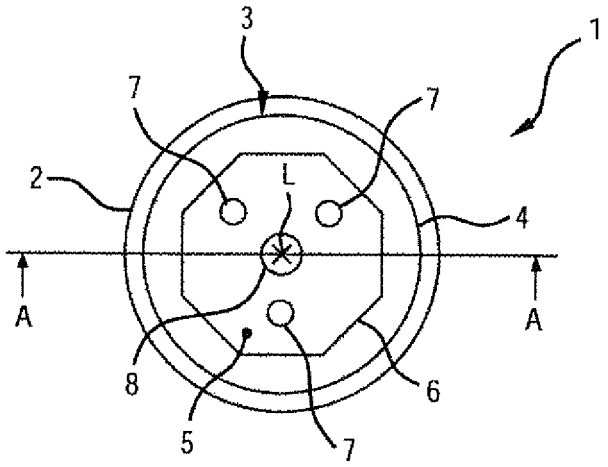
FIG. 1 shows in plan view an LED retrofit lamp with equipped carrier according to a first embodiment.

FIG. 1 shows in a plan view an LED retrofit lamp 1 carrier according to a first embodiment. The LED retrofit lamp 1 is used here instead of a conventional bulb with Edison base and therefore has an external contour which, at least in its basic shape, roughly reproduces the contour of a conventional bulb (see also FIG. 3). The LED retrofit lamp 1 includes an outer shell 2 into which an LED module 3 is inserted. The LED module 3 includes an aluminum heat sink 4 to the top or front face 5 shown here of which an $Al_2O_3$ carrier 6 with an octagonal external contour is secured. The carrier 6 is fitted with semiconductor light sources in the form of light-emitting diodes 7. The light-emitting diodes 7 illuminate into the upper half-space, i.e. in this diagram with a main direction of beam out of the image plane. The carrier 6 includes a central hole with which the carrier 6 can be placed closely over a supply constructed as a cable duct 8 here. The cable duct 8 is used as an element for feeding through electric lines (top diagram) from a driver located in the heat sink 4 (top diagram) to the carrier 6. The carrier 6 and the cable duct 8 are therefore coaxially positioned with respect to a longitudinal axis L, protruding perpendicularly from the image axis, of the lighting device 1, the longitudinal axis L extending centrally through the cable duct 8.

Figure 2:
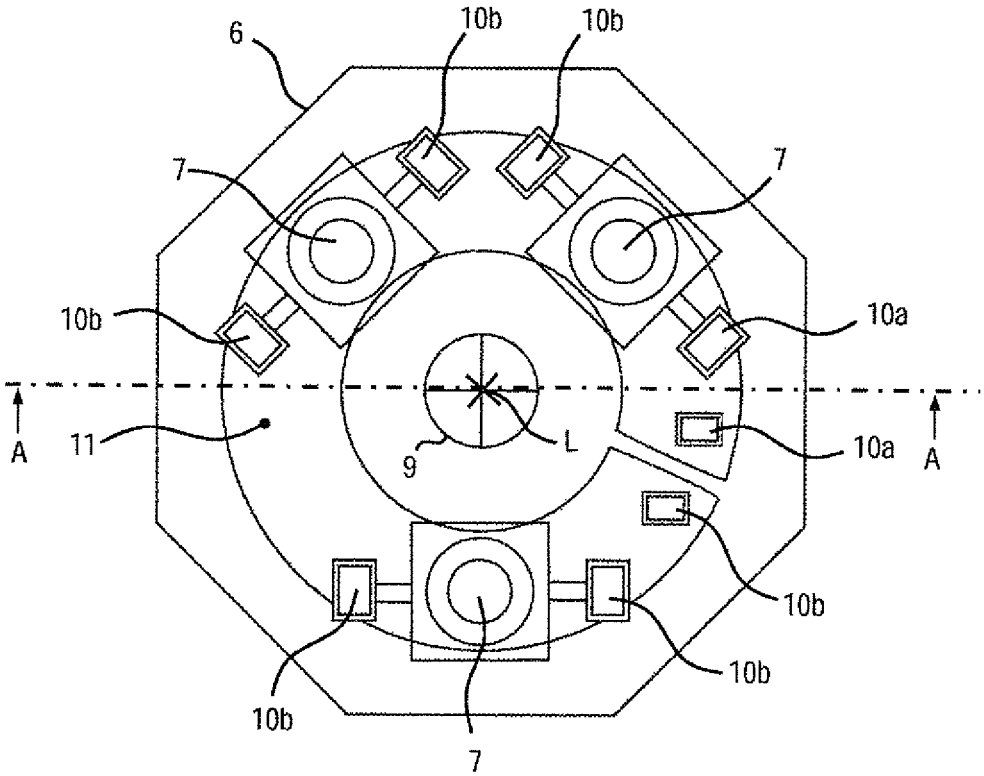
FIG. 2 shows in a plan view the carrier of FIG. 1 in a detailed diagram.

FIG. 2 shows in a plan view the carrier 6 of FIG. 1 in a detailed diagram. A front face 5 of the carrier 6 is fitted with three white light-emitting diodes 7 which are arranged approximately angularly symmetrically around a longitudinal axis L, the longitudinal axis L extending centrally through the hole 9 in the carrier 6. For their power supply the light-emitting diodes 7 can be brought into electrical contact with the carrier 6 by means of contact faces 10*a*. For power supply electric lines (top diagram) are guided from the driver through the cable duct to cable connecting faces 10*b*. The electric tracks used for power supply are formed by an appropriately structured outer copper layer 11 (shown very simplified here). The contact faces 10*a* and the cable connecting faces 10*b* and the copper layer 11 are potential-carrying surface regions which are electrically insulated from the heat sink 4 over sufficiently long insulation sections at least by means of the carrier 6. The copper layer 11 is not completely circumferential but has a gap 12 that extends radially with respect to the longitudinal axis L to avoid a short circuit.

Figure 3:
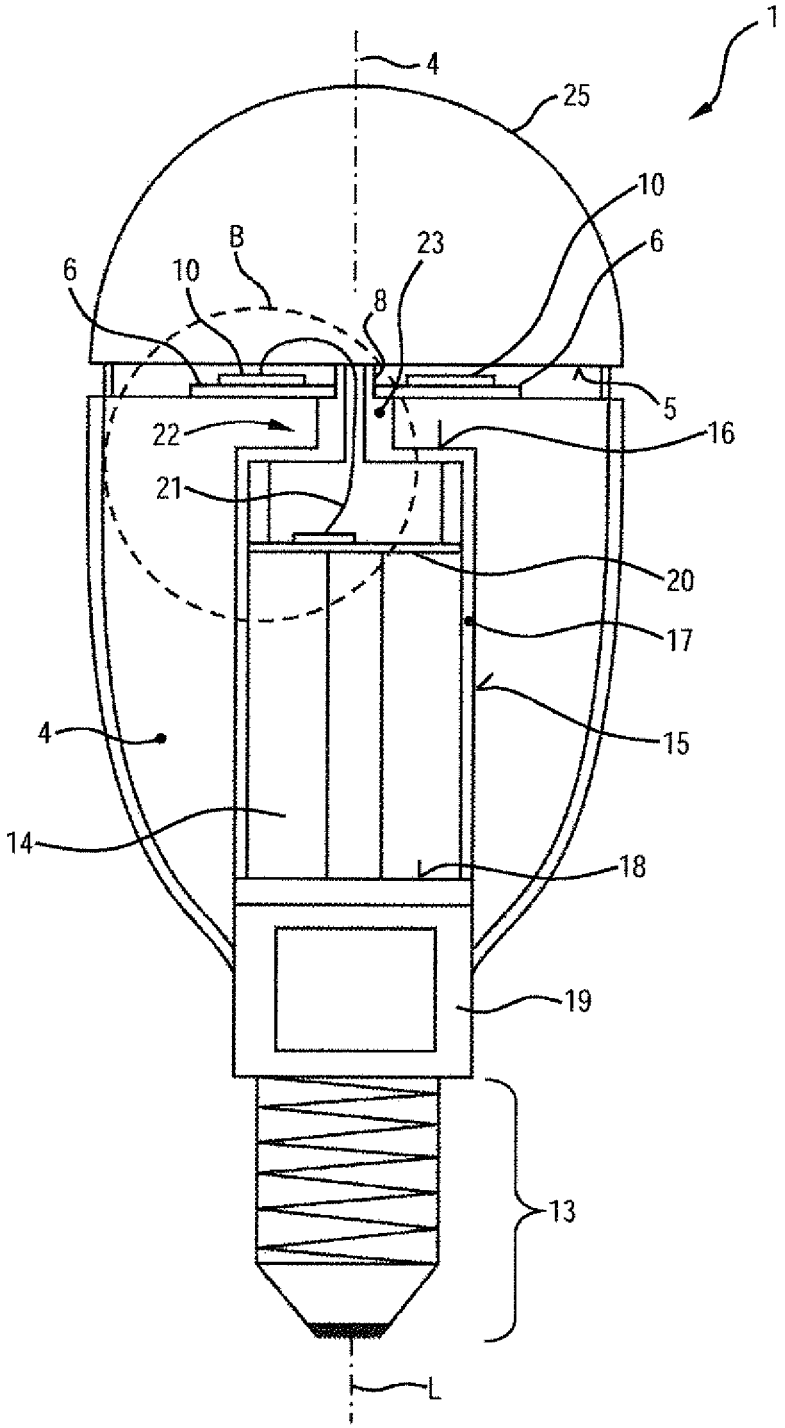
FIG. 3 shows in a side view the LED retrofit lamp according to the first embodiment as a sectional diagram along the cutting line A-A of FIG. 1.

FIG. 3 shows the LED retrofit lamp 1 according to the first embodiment as a sectional diagram along the cutting line A-A of FIG. 1. The LED retrofit lamp 1 does not project above the external contour of a conventional bulb and with its Edison base can be used instead of a corresponding bulb. A cylindrical recess in the form of a driver cavity 14 is present in the heat sink 4 and at its lateral circumferential surface 15 and upper end face 16 is occupied by an electrically insulating lining 17 (hereinafter also called "housing of the driver cavity") made of plastic material. A lower insertion opening 18 is sealed in an electrically insulating manner from the heat sink 4 by an attachment 19 which also contains the Edison base 13. A driver circuit board 20 is accommodated in the driver cavity 14 or lining 17 and includes all or at least some of the elements required to operate the light-emitting diodes 7. The driver circuit board 20 is electrically connected for this purpose to the Edison base 13 for power supply and passes the voltage and/or current required to operate the light-emitting diodes 7 via electrical cables 21 to the light-emitting diodes 7. For this purpose the driver circuit board 20 is connected by the electrical cables 21 to suitable cable connecting faces 10*b*. The driver implemented on the driver circuit board 20 is a transformer-less non-SELV driver here. Separation between primary side and secondary side principally occurs between the carrier 6 and the heat sink 4. For voltage conversion the transformer-less non-SELV driver may include a coil or a buck configuration and/or a stepdown converter.

For feeding the cables 21 through the upper end face 16, the upper end face 16 comprises a feed-through opening 22. For electrical insulation of the driver circuit board 20 from the heat sink 4 the lining 17 is designed in such a way that the cable duct 8 is integrally integrated in the lining 17 and connects the recess 14 or the inside of the lining 17 to the front face 5 of the heat sink 4. For its protection and for homogenization of the light emitted by the lighting device the front face 5 is covered by an opaque or light-scattering bulb 27. The bulb 27 can, by way of example, be clamped onto the heat sink 4 and equipped for example with a circumferential contact aid in the form of a holding-down device for the carrier.

Figure 4:
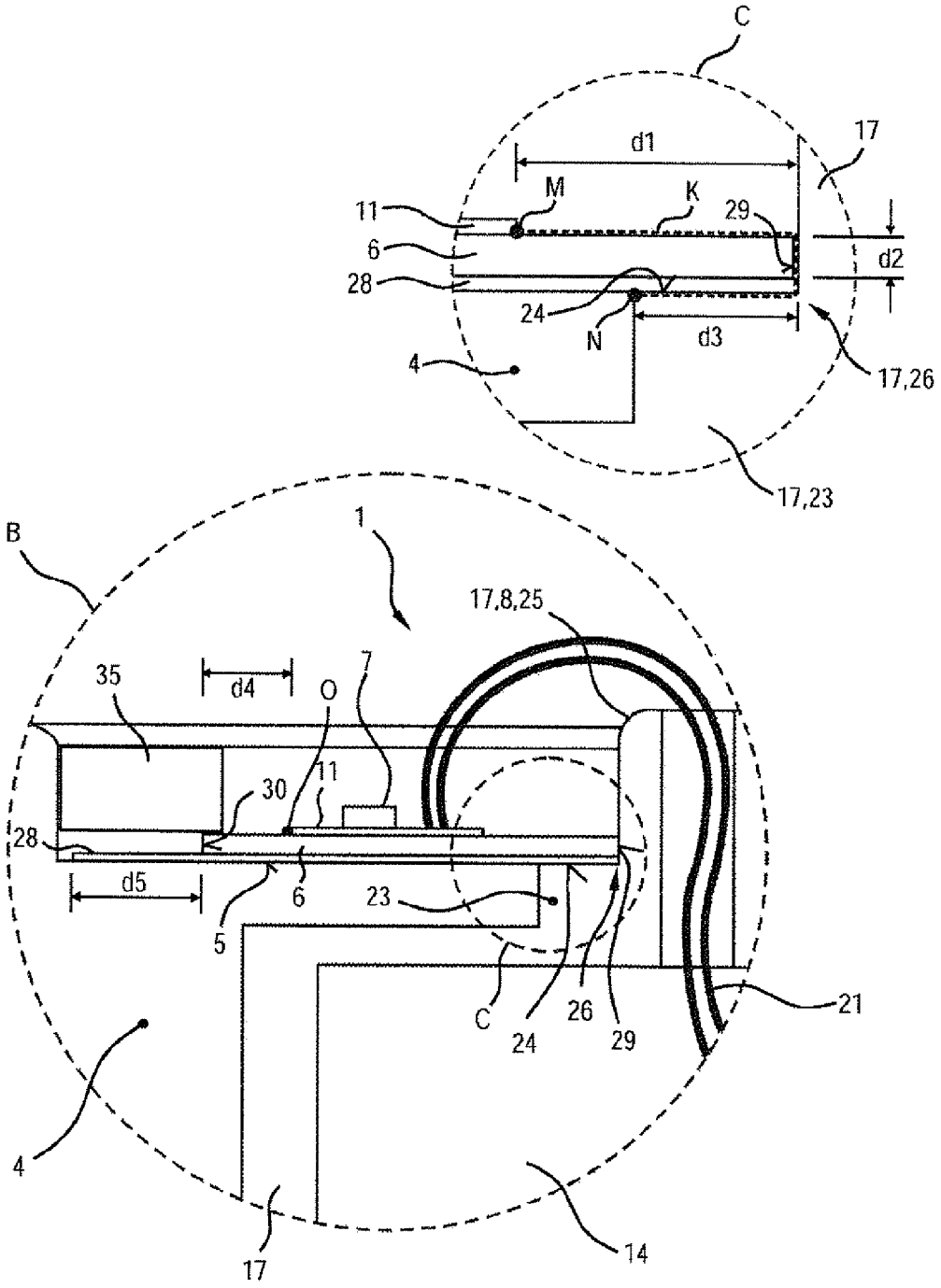
FIG. 4 shows a detail of FIG. 3 of the LED retrofit lamp according to the first embodiment in the region of a cable duct.

FIG. 4 shows a detail B of the LED retrofit lamp 1 of FIG. 3 as indicated there by the circle B. Furthermore, a detail C of the LED retrofit lamp 1 in the region of the contact surface 24 is shown. The cable duct 8 has a radially extended region 23 whose upper surface is used as a contact surface 24 for the carrier 6 when the lining is inserted and rests on the front face 5 of the heat sink 4 in a flush manner. A front-end, plane face 5, 24 perpendicular to the longitudinal axis L is created for contact of the carrier 6 as a result. To guide the cable 21 to the carrier 6 without problems the lining 17 or the cable duct 8 integrated therein comprises a projection 25 that is vertically outwardly directed from the heat sink 4 (here: in the longitudinal direction L). The projection 25 and the contact surface 24 of the lining form a rectangular step 26. The carrier 6 closely surrounds the projection 25 (with little clearance or tolerance), so the projection 25 can act as a centering aid during assembly of the carrier 6. The carrier 6 completely covers the contact surface 24 and partially covers the plane front face 5 of the heat sink 4. The carrier 6 is connected on the underside to the contact surface 24 and the plane front face 5 by way of an electrically insulating and adhering interface layer 29 made of a thermal interface material (TIM). The interface layer 28 provides additional breakdown protection and has good heat conductivity. The interface layer 28 also extends on the inside as far as the projection 25 and protrudes at the outside (in the lateral direction perpendicular to the longitudinal axis L) beyond the carrier 6. To ensure a secure fit of the carrier 6 on the heat sink 4 the carrier 6 is pressed by means of a pressure element 35, which is in the form of an electrically insulating, circumferential plastic ring here, onto the heat sink 4. The pressure element 35 can, by way of example, itself be pressed onto the carrier 6 by means of a contact aid ('holding-down device') which is not shown here, the contact aid being located on the bulb for easy assembly. The contact aid may, by way of example, be circumferential. As may be seen in particular in detail C, the electrically insulating contact surface 24 lengthens an inner leakage path K (shown in dotted lines) over the inner edge 29 of the carrier 6. A start M of the shortest inner leakage path K can therefore begin at the copper layer 11 and run radially to the inner edge 29 of the carrier (to the right in FIG. 4), from there downwards over the inner edge 29 of the carrier 6 and the interface layer 28 (ignoring the thickness of the interface layer 28), and back out again (to the left in FIG. 4) via the contact surface 24 through to a next point N on the heat sink 4. The total length of the leakage path K results from an addition of the distance d1 of the copper layer 11 from the inner edge 29 of the carrier, the thickness d2 of the carrier 6 and optionally the interface layer 28 and from the adjoining distance d3 of the inner edge 29 from the heat sink (and this matches the radial or lateral extension of the contact surface 24). In the illustrated exemplary embodiment a length of the leakage path K of d1=3.5 mm+d2=0.4 mm+d3=2 mm of a total of 5.9 mm thus results with a lateral distance of the copper layer 11 from the projection 25 of only d1=3.5 mm. A sufficiently long inner leakage path K or insulation section can therefore be provided in a laterally particularly compact manner.

In general the leakage path should be chosen such that device safety requirements are met. Rules in relation to this are laid down in various standards. In general a leakage path of more than 6.4 mm has proven to be sufficiently safe for common applications.

A leakage path extending over an outer edge 30 of the carrier 6, as shown in detail B, is calculated in this embodiment from a lateral distance d4=2.2 mm between an outer point O of the copper layer 11 and the outer edge 30, plus the thickness or depth of the outer edge 30 of d2=0.4 mm and the radial extension d5=3.3 mm of the region of the interface layer 28 protruding outwards beyond the carrier up to a point P on the heat sink 4. This results in a total outer leakage path of 5.9 mm as well, the lateral space gain matching the thickness of the carrier 6 of d2=0.4 mm here.

Figure 5:
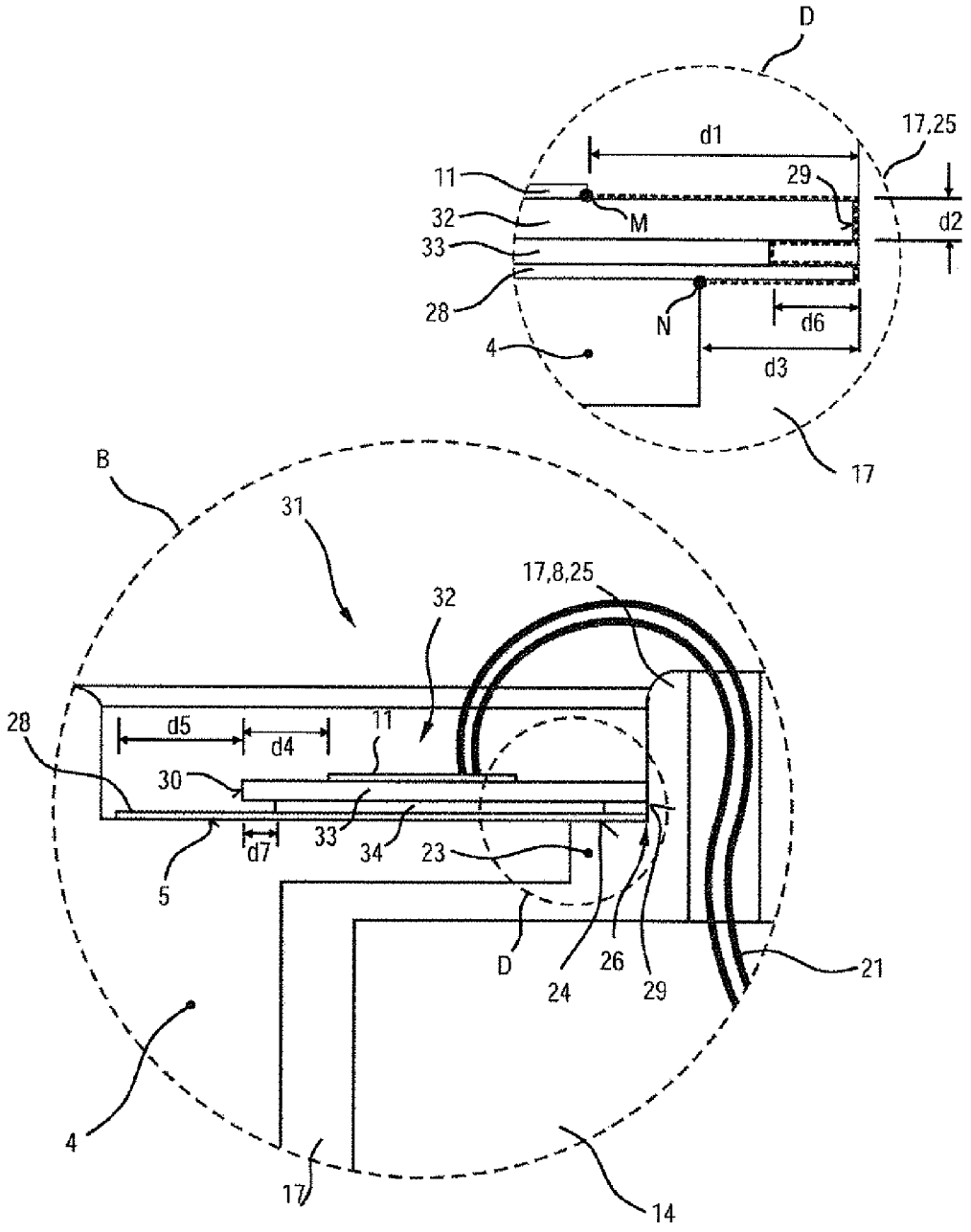
FIG. 5 shows in a view analogous to FIG. 4 a detail in the region of a cable duct of an LED retrofit lamp according to a second embodiment.

FIG. 5 shows in a view analogous to FIG. 4 a detail in the region of a cable duct 8 of an LED retrofit lamp 31 according to a second embodiment in which the carrier 32 accordingly has a different design from the first embodiment. More precisely, the carrier 32 has a multi-layer design such that it has an $Al_2O_3$ insulation layer 33, identical to the carrier 6 from the first embodiment, on the top of which the copper layer 11 is provided, a metal layer in the form of a lower copper layer 34 now being provided on the underside of the insulation layer 33, however. The carrier 32 can then be designed particularly easily as a double-sided DCB-bonded ("Direct Copper Bonding") carrier 32. The lower copper layer 34 is therefore located between two electrically insulating layers, namely the interface layer 28 and the insulation layer 33. Opposite the insulation layer 33 the lower copper layer 34 includes a respective offset or recess d6 or d7 at each edge, so, ignoring a thickness of the copper layer 34, a leakage path lengthened by twice the radial or lateral length d6 or d7 of the recess compared with the first embodiment respectively results. More precisely, as is shown more closely in detail D, with the same lateral extension, the inner leakage path can consequently be lengthened at the inner edge 29 from 5.9 mm to 5.9 mm+2·d6=5·9 mm+2·1.1 mm=8.1 mm. The outer leakage path can analogously be lengthened from 5.9 mm to 5.9 mm+2·d7=5.9 mm+2·0.6 mm=7.1 mm.

Figure 6:
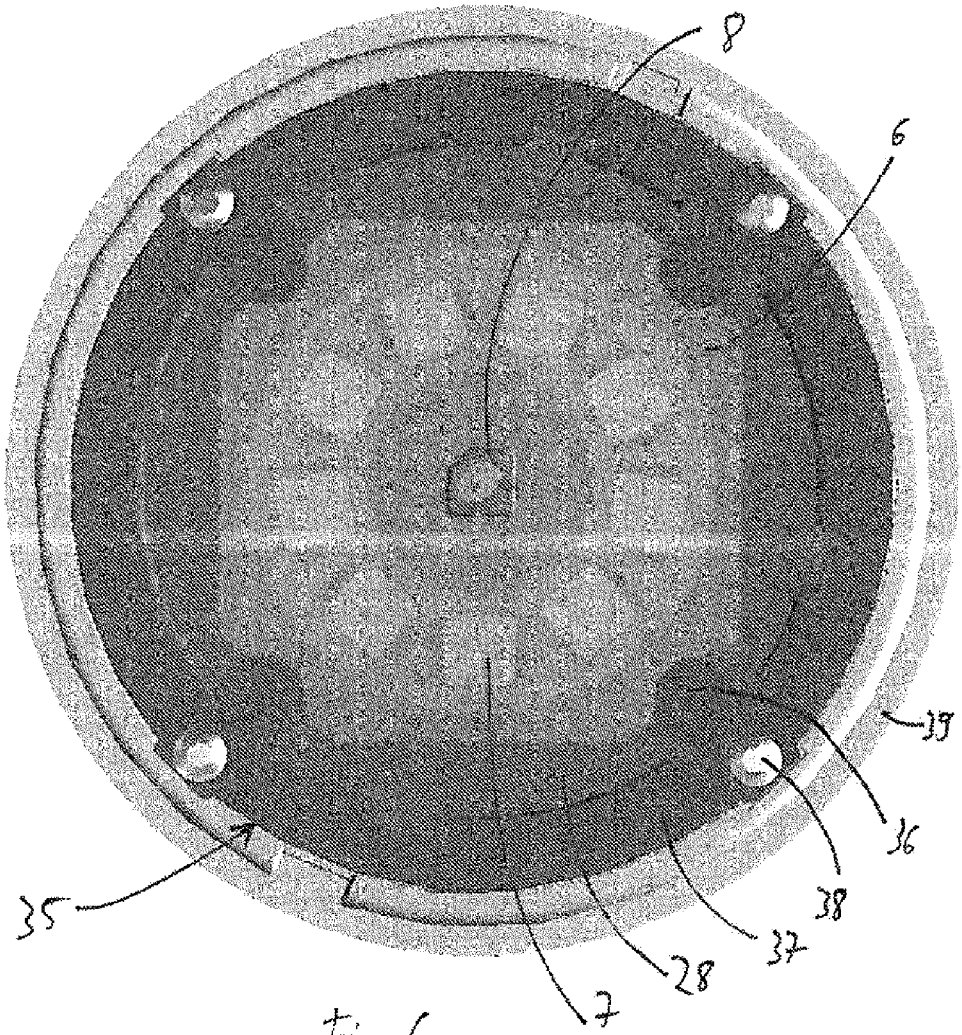
FIG. 6 shows an example of securing of a carrier by means of a pressure element.

FIG. 6 shows an example of securing of the carrier 6 by means of a pressure element 35. The carrier 6 with the light-emitting diodes 7 surrounds the cable duct 8 and is fixed to the heat sink 4 or the interface layer 28 by four retaining clips 36. The retaining clips 36 together with a retaining ring 37 substantially form the pressure element 35. Retaining pins 38 are used for positioning and fixing. A circumferential contact aid 39 is also provided. The retaining pins can be designed in accordance with the knowledge of a person skilled in the art, by way of example as press fit pins, snap connectors, screws or as hot-swage pins.

Obviously the present invention is not limited to the illustrated exemplary embodiments. It may therefore be generally advantageous if at least one of the distances d1 to d7 is at least 1 mm long, preferably between 1 mm and 5 mm. Generally it can also be preferred if the length of the leakage path or leakage sections is at least 1 mm, particularly preferably at least 5 mm. Apart from pure aluminum the material of the heat sink can also be an aluminum alloy or a different metal or its alloy or a plastic material having good heat conductivity. The cable duct can also be eccentrically arranged (laterally offset with respect to the longitudinal axis). The supply can generally be a separate component or be integrated, for example integrally, by way of example in the lining of the recess and/or the heat sink.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE CHARACTERS

1 LED retrofit lamp
2 shell
3 LED module
4 heat sink
5 front face
6 carrier
7 light-emitting diode
8 cable duct
9 hole in carrier
10 contact face
11 copper layer
12 gap
13 Edison base
14 driver cavity
15 circumferential surface
16 upper end face
17 lining
18 insertion opening
19 attachment
20 driver circuit board
21 cable
22 feed-through opening
23 radially extended region
24 contact surface
25 projection
26 step
27 bulb
28 interface layer
29 inner edge of the carrier
30 outer edge of the carrier
31 LED retrofit lamp
32 carrier
33 insulation layer
34 lower copper layer
35 pressure element
36 retaining clip
37 retaining ring
38 retaining pin
39 contact aid
d distance
K inner leakage path
L longitudinal axis
M start of the inner leakage path
N end of the inner leakage path
O start of the outer leakage path
P end of the outer leakage path

The invention claimed is:

1. A lighting device, comprising heat sink, which has at least one carrier attached to the outside of the heat sink for at least one semiconductor light source; a recess for accommodating a driver; and at least one electrically insulating supply, which connects the recess to the outside of the heat sink; wherein the electrically insulating supply comprises a contact surface that connects to the outside of the heat sink in a flush manner, the contact surface being at least partially covered by the carrier, wherein the electrically insulating supply further comprises a projection protruding outwardly with respect to the outside of the heat sink, wherein a surface of the projection and the contact surface form a step.

2. The lighting device as claimed in claim 1, wherein the carrier is secured to the heat sink by means of an electrically insulating interface layer.

3. The lighting device as claimed in claim 2, wherein the interface layer extends laterally over at least one of an inner edge and for an outer edge of the carrier.

4. The lighting device as claimed in claim 2, wherein the carrier comprises an insulation layer and a metal layer arranged on the underside thereof; wherein the underside metal layer is laterally set back at at least one of an inner edge and an outer edge of the carrier.

5. The lighting device as claimed in claim 4, wherein the underside metal layer is a direct copper bonding layer.

6. The lighting device as claimed in claim 1, wherein the carrier is arranged circumferentially and concentrically with respect to the electrically insulating supply.

7. The lighting device as claimed in claim 1, further comprising: at least one pressure element configured to press the carrier onto the heat sink.

8. The lighting device as claimed in claim 7, wherein the pressure element comprises a circumferential or part-circumferential ring made of an electrically insulating material.

9. The lighting device as claimed in claim 7, further comprising: a bulb which comprises a contact aid which is configured to press onto at least one of the carrier and the pressure element.

10. The lighting device as claimed in claim 1, wherein at the top the carrier comprises at least one electrically conductive surface region which maintains a minimum distance from an inner edge of at least one of the carrier and an outer edge of the carrier.

11. The lighting device as claimed in claim 1, wherein the semiconductor light source is fed by a non-safety extra-low voltage voltage.

12. The lighting device as claimed in claim 11, wherein the driver is a transformer-less non-safety extra-low voltage driver.

13. The lighting device as claimed in claim 1, which is designed as a light emitting diode retrofit lamp or as a light emitting diode module for a light emitting diode retrofit lamp.

14. The lighting device as claimed in claim 1, wherein the at least one semiconductor light source comprises a light-emitting diode.

15. The lighting device as claimed in claim 1, wherein the surface of the projection and the contact surface form a rectangular step.

16. The lighting device as claimed in claim 10, wherein the at least one electrically conductive surface region maintains a minimum distance from the inner edge of the at least one of the carrier and the outer edge of the carrier of 3.5 mm or more.

* * * * *